US007938705B2

(12) United States Patent
Fitzgerald

(10) Patent No.: US 7,938,705 B2
(45) Date of Patent: May 10, 2011

(54) ADJUSTABLE FLEX WATERBOARD STRINGER

(75) Inventor: David Fitzgerald, Emeryville, CA (US)

(73) Assignee: Wham-O, Inc., Woodland Hills, CA (US)

( * ) Notice: Subject to any disclaimer, the term of this patent is extended or adjusted under 35 U.S.C. 154(b) by 35 days.

(21) Appl. No.: 12/490,141

(22) Filed: Jun. 23, 2009

(65) Prior Publication Data

US 2010/0323567 A1 Dec. 23, 2010

Related U.S. Application Data

(60) Provisional application No. 61/075,659, filed on Jun. 25, 2008.

(51) Int. Cl.
*B63B 35/79* (2006.01)

(52) U.S. Cl. ..... 441/74

(58) Field of Classification Search ..... 114/39.14; 441/65, 74, 79

See application file for complete search history.

(56) References Cited

U.S. PATENT DOCUMENTS 6,036,560 A * 3/2000 Pekar ..... 441/65

* cited by examiner

*Primary Examiner* — Ed Swinehart

(57) ABSTRACT

A waterboard with externally adjustable stiffness includes a stringer assembly having a rotatable beam to modulate the stiffness of the beam in a selected direction to impart a desired stiffness to the waterboard.

20 Claims, 9 Drawing Sheets

ADJUSTABLE FLEX WATERBOARD STRINGER

RELATED APPLICATION

This application claims priority under 35 U.S.C. §119(e) to U.S. provisional application No. 61/075,659, filed Jun. 25, 2008, the entire contents of which are incorporated herein by reference.

BACKGROUND OF THE INVENTION

1. Field of the Invention

The present invention relates generally to waterboards and stiffening elements thereof.

2. Discussion of the Background

Sports boards composed of a preformed, preshaped, generally planar foam core with a slick bottom skin are very popular for use on water, snow, grass, ice or other surfaces. One type of sports board is a waterboard such as bodyboard or surf board and is employed in the water, more particularly for wave surfing. Generally, waterboards are made of semi-rigid foam core, typically with polystyrene foam, polyethylene foam or polypropylene foam, and have polyethylene foam sheets laminated to the top and side surfaces of the foam core, and have a bottom surface composed of a polymeric film material such as polyethylene or Surlyn® to provide a low-friction surface.

During wave riding, a user may bend the board and turn on the water. The board typically restores to a neutral position after bending. The recovery of the original shape is referred as the 'memory' of the foam core. Polypropylene foam cores have better memory characteristics than other foam core materials. Therefore, a polypropylene foam core is typically used for high end performance waterboards due to its resiliency, rigidity and light weight.

Typically, waterboards are ridden in a prone position, with one arm extending forward for gripping the nose of the board and the other arm positioned in a trailing manner for gripping the front portion of the side edge of the board. With the arms and hands thus positioned, the rider can push or pull against the engaged front or side edges to bend or twist the board to increase friction and drag on selected parts of the board, which helps the rider in redirecting the board. It is generally desirable to have a bodyboard with low flexibility (i.e., high stiffness) in the rearward portion of the board and higher flexibility in the forward portion of the board. This combination provides stiff support for the rider's body on the rearward portion of the board while allowing the rider to maneuver the board as described above.

A variety of stringers and stiffening methods have been described in the prior art. U.S. Pat. No. 6,036,560 (the '560 patent) discloses an encapsulated two-part stringer rod having a stiff portion in the body and tail of the bodyboard and a less stiff portion toward the nose of the bodyboard. The flexible front nose area provides greater maneuverability for the bodyboard. The '560 patent discloses an elongated stringer element comprising a stiff rear portion fabricated from fiberglass or graphite resin-impregnated material and a flexible front portion fabricated from a polyethylene material. the stringer is generally longitudinally arranged within the foam core material of the board and extends substantially from the tail end toward the front end.

U.S. Pat. No. 7,347,754 (the '754 patent) also discloses a two part encapsulated stringer providing greater stiffness in the body of the bodyboard and less stiffness in the nose of the bodyboard. The amount of stiffness imparted to the body is determined by a fiberglass tube and the amount of flexibility imparted to the nose is determined by a helical coil or spring.

The disadvantage of using an encapsulated stringer is that once a particular stiffness profile is selected at the time of manufacture, it cannot be changed. Riders vary in weight and strength and wave riding skills, so the optimum level of flexibility varies from rider to rider. It would be desirable, therefore, to provide a waterboard with externally adjustable stiffening element(s) configured to provide variable resistance to flex.

BRIEF SUMMARY OF THE INVENTION

Embodiments of the invention relate to a bodyboard with an externally adjustable flexibility. In particular, a bodyboard with an externally adjustable, variable stiffness stringer element is provided. The present invention incorporates a rotatable beam in lieu of a helical spring or a solid plastic rod used by the prior art. The rotatable beam significantly improves the ease of adjustment and the range of flexibility adjustment.

In embodiments having features of the invention, a waterboard having externally adjustable stiffness includes a generally elongated foam core having a forward nose and a rearward tail and a longitudinally disposed channel within. In one embodiment, the channel may have a generally cylindrical cross-section having an approximately uniform diameter, an opening at the tail and terminating within in forward portion of the foam core. In other embodiments, the channel may have an elliptical or polygonal cross-section and may also have a non-uniform cross-section. The waterboard further includes an adjustable flex stringer assembly disposed substantially within the channel, the adjustable flex stringer assembly including: a housing having a cylindrical bore, configured to create a friction or interference fit with the channel and occupying a rearward portion of the channel; a stringer comprising a cylindrical shank disposed within the cylindrical bore of the housing and a beam element disposed within approximately a forward third of the channel; an end cap engaged with the cylindrical shank and configured to rotate the stringer under an application of torque, wherein the stiffness of the beam element in a direction normal to a surface of the waterboard is modulated between a minimum stiffness and a maximum stiffness.

In embodiments having features of the invention, a waterboard having externally adjustable stiffness includes a generally elongated foam core having a forward nose and a rearward tail and a longitudinally disposed channel within. An adjustable flex stringer assembly is disposed substantially within the channel, the adjustable flex stringer assembly including: a stringer comprising a shank portion and a beam portion, said shank portion being disposed rearward of said beam portion when said adjustable flex stringer assembly is in position within said channel, said beam portion including a beam element disposed within approximately a forward third of the channel; and an end cap engaged with the shank and configured to rotate the stringer under an application of torque, wherein the stiffness of the beam element in a direction normal to a surface of the waterboard is modulated between a minimum stiffness and a maximum stiffness.

BRIEF DESCRIPTION OF THE DRAWINGS

The present invention is illustrated by way of example and not limitation in the figures of the accompanying drawings, in which.

DETAILED DESCRIPTION

An adjustable stiffness stringer for a waterboard is described. In the following description, numerous specific details are set forth such as examples of specific methods, materials, components, etc. in order to provide a thorough understanding of the present invention. It will be apparent, however, to one skilled in the art that these specific details need not be employed to practice the present invention. In other instances, well-known materials or methods have not been described in detail in order to avoid unnecessarily obscuring the present invention. Embodiments of the invention are directed to an adjustable flex waterboard which includes a preformed, preshaped board such as a bodyboard or a surfboard, having a generally planar form with top and bottom surfaces, a nose end, a tail end and two opposing side rail surfaces which may extend from one end to the other end of the board. The board may include a low density closed-cell thermoplastic foam core such as polystyrene, polyethylene, polypropylene foam material or the like. A low-friction thermoplastic polymer film material may be laminated to the bottom surface of the board and the upper and lower rail surfaces and the top surface may be covered by a closed-cell foam material having a higher density than the foam core. The board includes a stringer assembly that may be externally adjusted to alter the flexibility of the waterboard.

Figure 1:
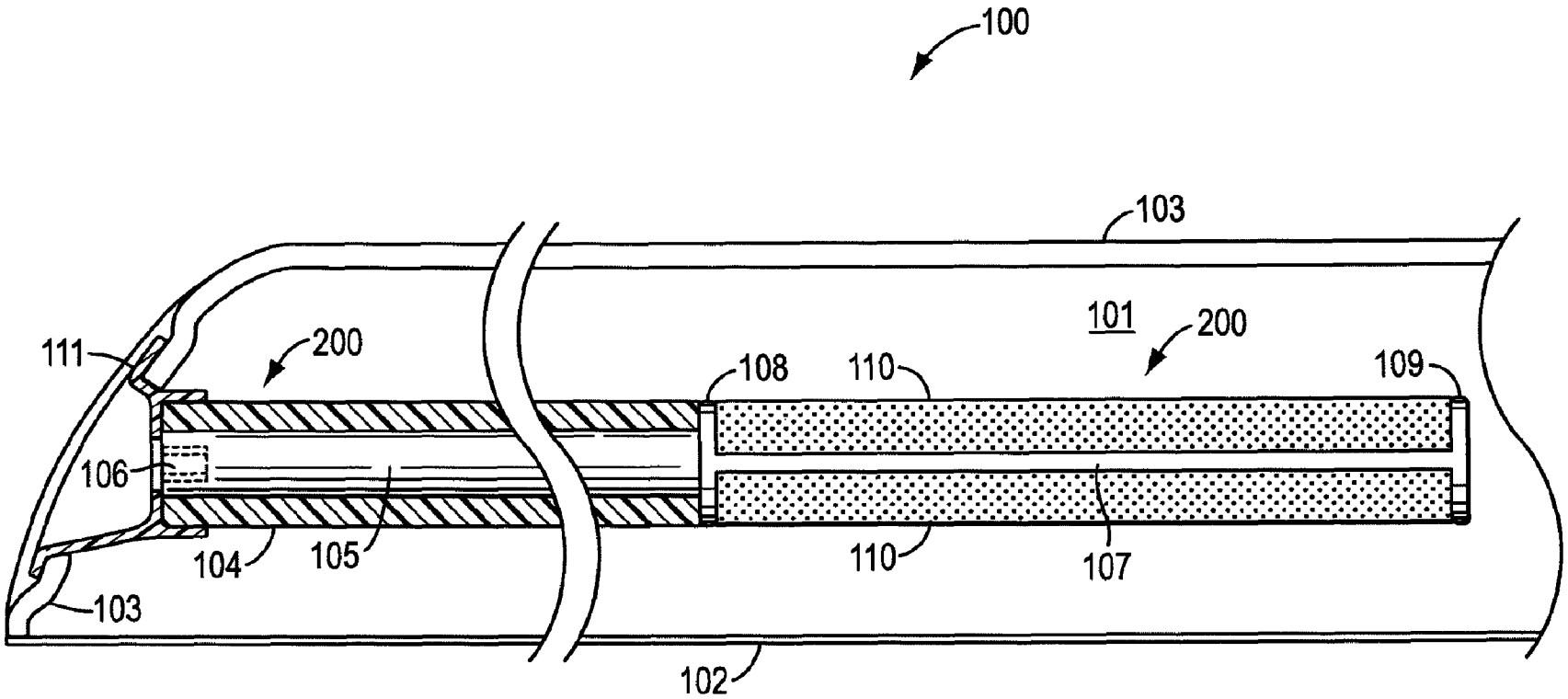
FIG. 1 is a cross-sectional view of a waterboard illustrating an adjustable flex stringer according to one embodiment of the invention.

FIG. 1 is a cross-sectional view of a waterboard 100 including an adjustable flex stringer assembly 200 according to one embodiment of the invention. Waterboard 100 includes a low-density foam core 101, which may be molded or bored out to provide a channel for the insertion of the adjustable flex stringer assembly 200. In one embodiment, the channel may have a uniform circular cross-section over its length. As noted above, waterboard 100 may include a low-friction thermoplastic polymer film 102 on its bottom surface and a closed-cell foam 103 on its top and side rail surfaces as described above, although embodiments of the invention are not so limited and may utilize any type of materials and manufacturing processes as are known in the art.

The adjustable flex stringer assembly 200 includes a stiff housing element 104 of fiberglass or rigid plastic having a cylindrical internal bore. In one embodiment, as illustrated in FIG. 2, housing element 104 may have a circular cross-section with a diameter equal to or greater than the diameter of the channel in foam core 101 such that housing 104 has a friction fit or interference fit with the channel and is prevented from rotating thereby. In other embodiments, housing 104 may have a non-cylindrical cross-section that matches a cross-section of the channel such that housing 104 cannot be rotated within the channel. Housing 104 is configured to accept a cylindrical shank of a stringer element 105 with a sliding fit or friction fit such that the shank of stringer element 105 may be rotated within the cylindrical bore of housing element 104 with the application of suitable torque. Stringer element 105 may be fabricated (e.g., molded or machined) as a single piece of a flexible plastic such as nylon, delrin or other suitable material. The shank of stringer element 105 may include a counterbore 106, which may have a slotted, or irregular, or hexagonal or other polygonal shape, or any suitable shape configured to accept an Allen wrench, star wrench or other type of tool capable of rotating stringer element 105 within the cylindrical bore of housing 104. It will be appreciated that the stiffness of the stringer assembly over the length of the housing element 104 will be determined by the stiffness of the housing element 104 and not by the stiffness of the shank of stringer element 105.

Stringer element 105 also includes a beam segment 107 forward of the shank and terminated at its ends by disks 108 and 109. Disk 108 is located between the shank and beam element 107 and provides a stop to prevent stringer element 105 from sliding rearward with respect to housing element 104. Disk 109 is located at the forward end of beam segment 107 and bears against the bottom surface of the channel in foam core 101. In one embodiment, anti-buckling foam pieces 110 with approximately semicircular cross-sections may be placed on each side of beam element 107 as described in greater detail below. Anti-buckling foam pieces 110 may be the same material as foam core 101 or different material; in embodiments, anti-buckling foam pieces 110 may be made from low density foam. The diameters of disks 108 and 109, and the combined diameter of beam element 107 and foam pieces 110, may be less than the diameter of the channel in the foam core 101 such that beam element 107, foam pieces 110 and disks 108, 109 may rotate freely within the channel when a torque is applied to the shank of stringer element 105. In one embodiment, stringer assembly 200 may include an end cap 111 configured to retain stringer assembly 200 within waterboard 100. For example, end cap 111 may have a serrated or saw-toothed outer surface (not shown) as is known in the art to irreversibly engage foam core 101. Alternatively, end cap 111 may be glued or otherwise bonded to foam core 101 and surfaces 103. As illustrated in FIG. 1, end cap 111 may also include an outer flange to limit the penetration of the end cap into foam core 101 and an inner flange to retain housing 104. In embodiments, for example, end cap 111 may be made from low density polyethylene (LDPE) or other suitable material.

Figure 2A:
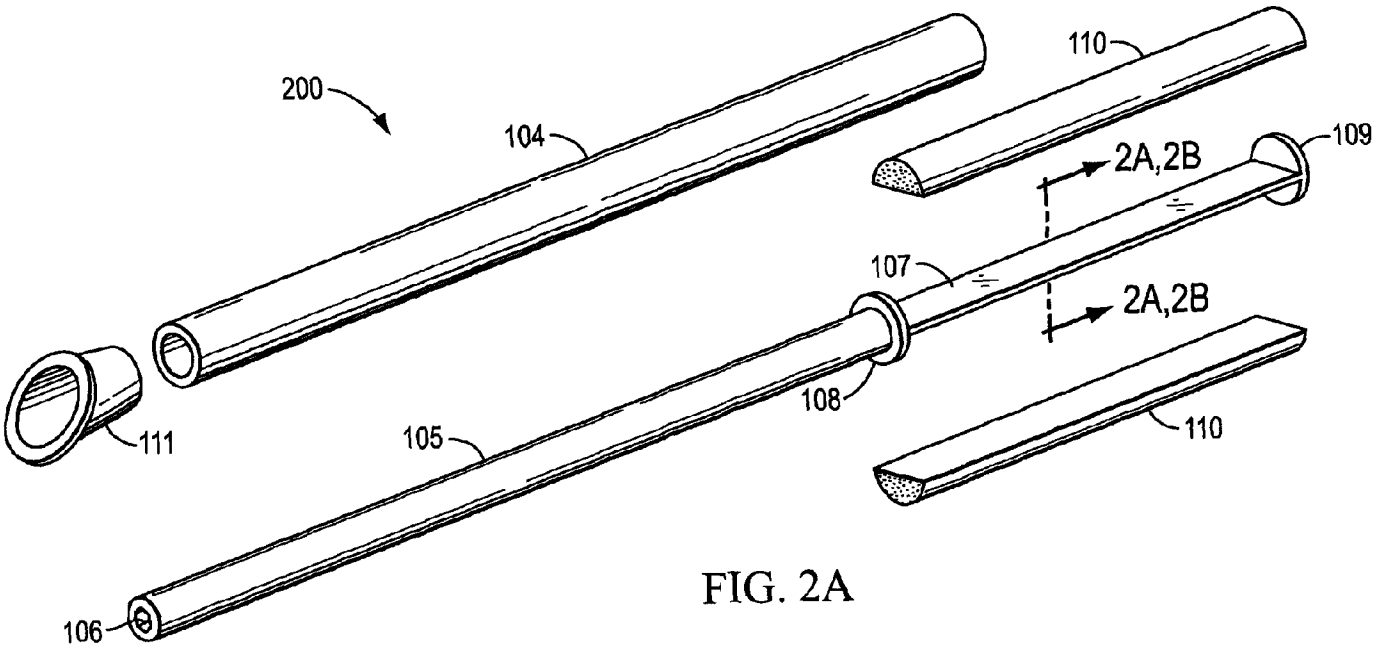
FIG. 2A is an exploded view of an adjustable flex stringer assembly according to one embodiment of the invention.

FIG. 2A is an exploded view of stringer assembly 200 illustrating all of the elements described above. From the foregoing description, it will be seen that the beam element 107 can be viewed as a cantilevered beam secured at disk 108 by housing element 104, which may be rotated within foam core 101 via the application of torque to the shank of stringer element 105. Beam element 107 has non-uniform stiffness in a direction normal to the top surface of waterboard 100 as a function of the rotational orientation of beam element 107 within the foam core 101. Stringer element 105 may be made from, for example, nylon or delrin or other suitable material.

Figure 2B:
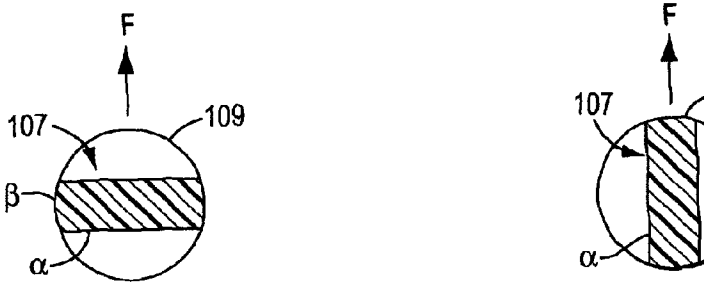
FIGS. 2B and 2C are cross-sectional views of the adjustable flex stringer of FIG. 2A in minimum and maximum stiffness configurations.
Figure 2C:
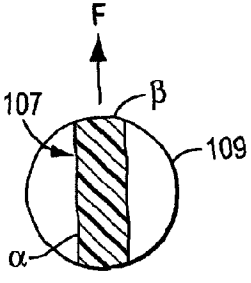

The stiffness of a beam is defined as the ratio of an applied force to the deflection of the beam in the direction of the force. FIGS. 2B and 2C are cross-sectional views of beam element 107 looking toward disk 109. As illustrated in FIGS. 2B and 2C, beam element 107 has an approximately rectangular cross-section with broad dimension α and narrow dimension β. When beam element 107 is rotated such that the broad dimension α is horizontal, as illustrated in FIG. 2B, the stiffness of the beam will be minimized in the direction of an applied force F. When beam element 107 is rotated such that the broad dimension α is vertical, then the stiffness of the beam will be maximized in the direction of the applied force F. Thus, the stiffness of a beam having features of the invention, such as beam element 107, is greater with respect to an applied force that is parallel to a broad dimension α (e.g., as illustrated in FIG. 2C), and the stiffness of a beam having features of the invention, such as beam element 107, is lesser with respect to an applied force that is perpendicular to a broad dimension α (e.g., as illustrated in FIG. 2B). Stiffness values between the minimum value and the maximum value may be obtained at intermediate angular orientations between horizontal and vertical. Anti-buckling foam pieces 110 prevent beam element 107 from buckling sideways or twisting when beam element 107 is in a non-minimum stiffness orientation.

Figure 3A:
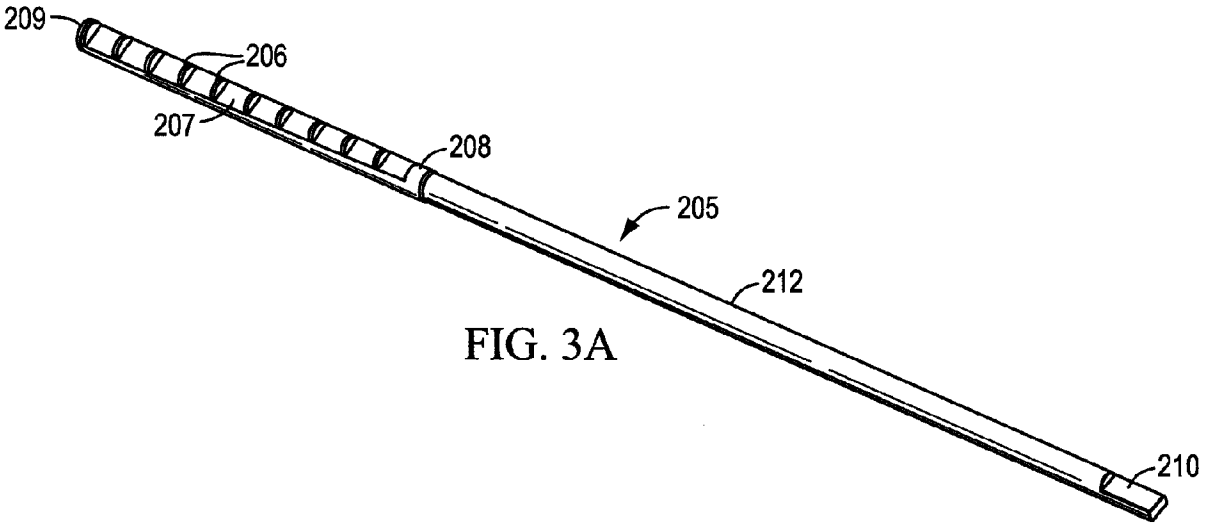
FIGS. 3A-3C illustrate a stringer according to one embodiment of the invention.
Figure 3B:
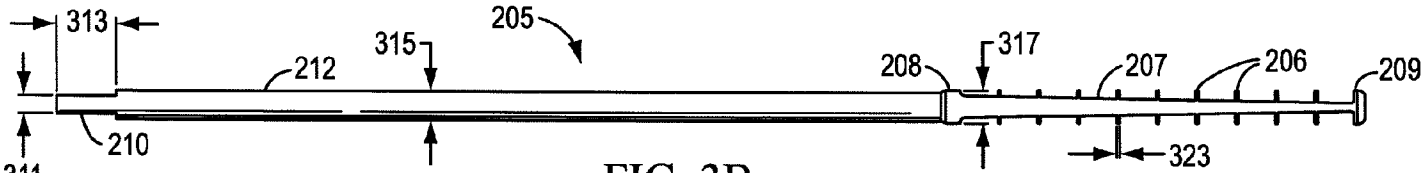
Figure 3C:
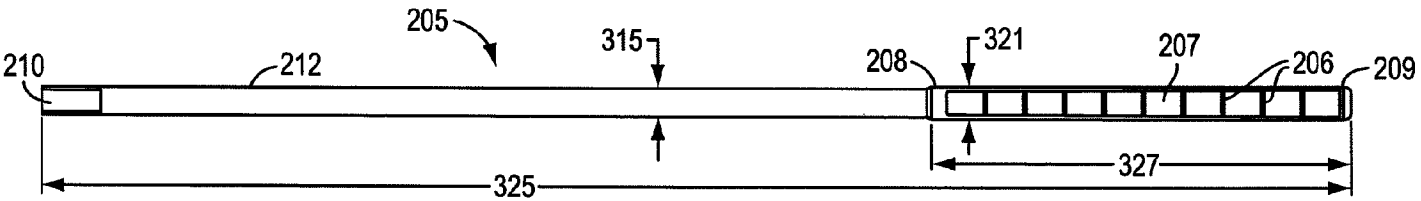

FIGS. 3A-3C illustrate an embodiment of a stringer element 205 that eliminates the need for anti-buckling foam pieces. FIG. 3A is a perspective view and FIGS. 3B and 3C illustrate minimum and maximum stiffness orientations respectively (assuming the same orientation of waterboard 100 illustrated in FIG. 1). As illustrated in FIGS. 3A-3C, stringer element 205 has a cylindrical shank 212 and a plurality of intermediate disk elements 206 spaced along a beam element 207 between end disk elements 208 and 209, respectively. Intermediate disk elements 206 and end disks 208 and 209 have a diameter small enough to allow beam element 207 to rotate freely within a cylindrical channel in foam core 101 and large enough to prevent beam element 207 from buckling under an applied stress as described above. In other respects, the operation and characteristics of stringer element 205 may be equivalent to those of stringer element 105. As illustrated in FIG. 3B, beam element 207 may also have a taper that provides a variation in stiffness along its length and a tenon 210 at its opposite end to engage a stiffness control mechanism as described below.

In embodiments, as illustrated in FIGS. 3A and 3B, a stringer element 205 may have a stringer length 325 which may be, for example, between about 20 inches and about 50 inches; or may be, for example, between about 25 inches and about 40 inches; or may be, for example, between about 30 inches and about 35 inches; and may be, for example, about 33 inches. In embodiments, a beam element 207 may have, for example, a length 327 of between about 5 inches and about 15 inches; or may have a length 327 of between about 8 inches and about 12 inches; or may have a length 327 of about 10.7 inches.

In embodiments, as illustrated in FIGS. 3A and 3B, a stringer element 205 may have a thickness 315 along a cylindrical shank portion 212; in embodiments, a shank thickness 315 may be, for example, between about 0.3 inches and about 1 inches, or between about 0.5 inches and about 0.9 inch, or may be between about 0.6 inches and about 0.8 inches, and may be, for example, about 0.68 inches. In embodiments, as illustrated in FIGS. 3A and 3B, an end disk element 208 may have a thickness 317 that may be, for example, between about 0.4 inches and about 1.2 inches, or between about 0.6 and about 1 inch, or may be, for example, about 0.8 inches. A beam element 207 may have a width 321 that may be, for example, between about 0.4 inches and about 1.2 inches, or between about 0.6 and about 1 inch, or may be, for example, about 0.8 inches. An intermediate disk element 206 may have a disk span 323 that may be, for example, between about 0.05 inches and about 0.2 inches, or between about 0.07 inches and about 0.1 inch, or may be, for example, about 0.9 inches.

In embodiments, as illustrated in FIGS. 3A and 3B, a stringer element 205 may have a tenon 210 having a thickness 311 and a length 313; in embodiments, a tenon thickness 311 may be, for example, between about 0.2 and about 0.6 inch, or between about 0.3 and about 0.5 inch, and may be, for example, about 0.4 inches. In embodiments, a tenon length 313 may be, for example, between about 0.3 and about 0.8 inch, or between about 0.4 and about 0.6 inch, and may be, for example, about 0.5 inches.

Figure 4A:
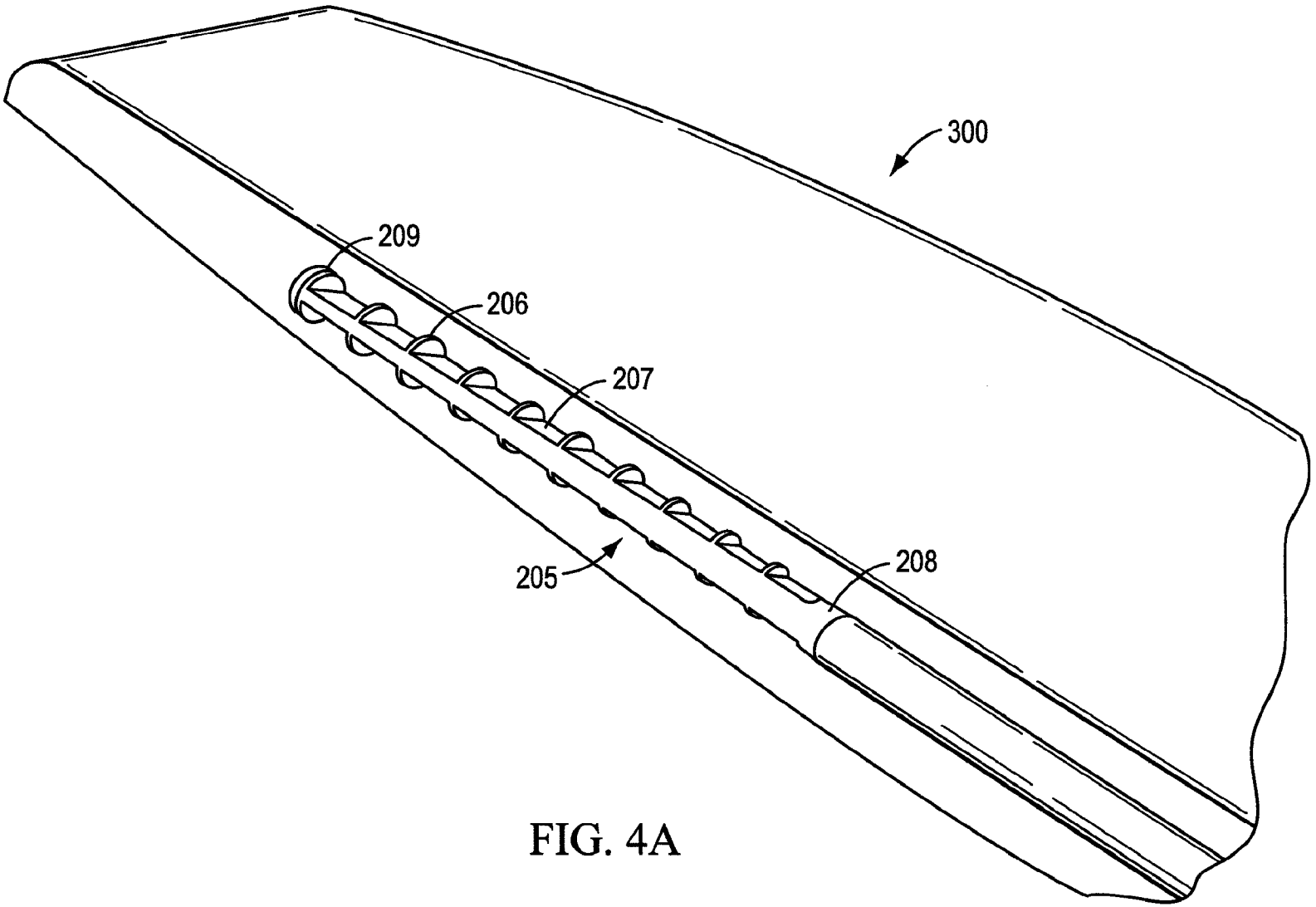
FIG. 4A illustrates an adjustable flex stringer in a minimum stiffness configuration according to one embodiment of the invention.
Figure 4B:
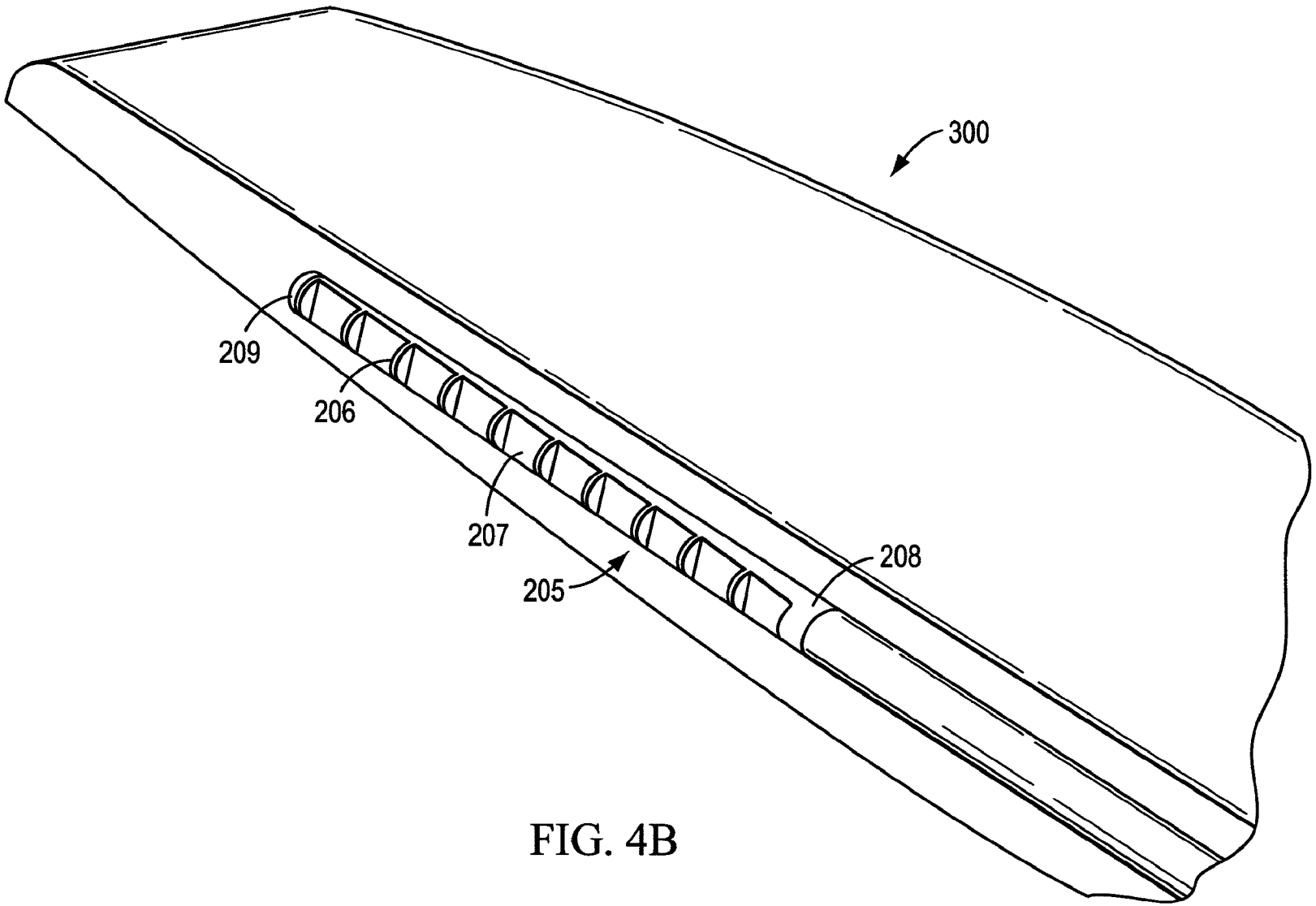
FIG. 4B illustrates an adjustable flex stringer in a maximum stiffness configuration according to one embodiment of the invention.

FIG. 4A is a cross-sectional perspective view of a waterboard 300 showing stringer element 205 with beam segment 207 in a minimum stiffness orientation. FIG. 4B is a cross-sectional perspective view of waterboard 300 showing stringer element 205 with beam segment 207 in a maximum stiffness orientation.

Figure 5:
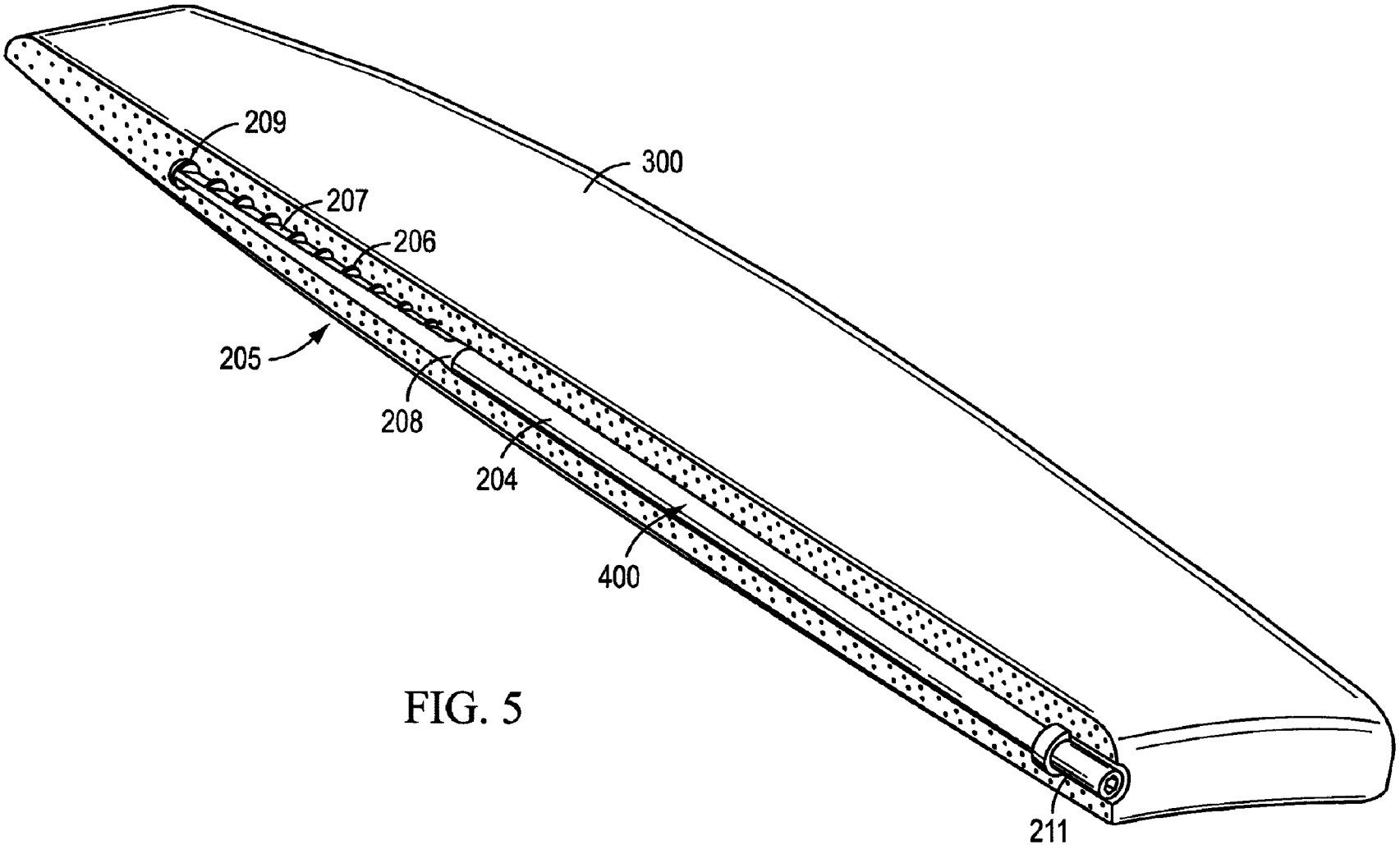
FIG. 5 is a cross-sectional perspective view of a waterboard illustrating an adjustable flex stringer according to one embodiment of the invention.

FIG. 5 is a cross-sectional perspective view of waterboard 300 illustrating an adjustable flex stringer assembly 400 according to one embodiment of the invention. Stringer assembly 400 includes a rigid housing element 204, which may be functionally and structurally similar to housing element 104 described above. Stringer assembly 400 also includes a stringer element 205 having a beam element 207 as described above and a cylindrical shank 212 (not visible in FIG. 5) engaged with housing 204. In one embodiment, as illustrated in FIG. 5, stringer assembly 400 may be retained within waterboard 300 by an end cap 211 as described below.

Figure 6:
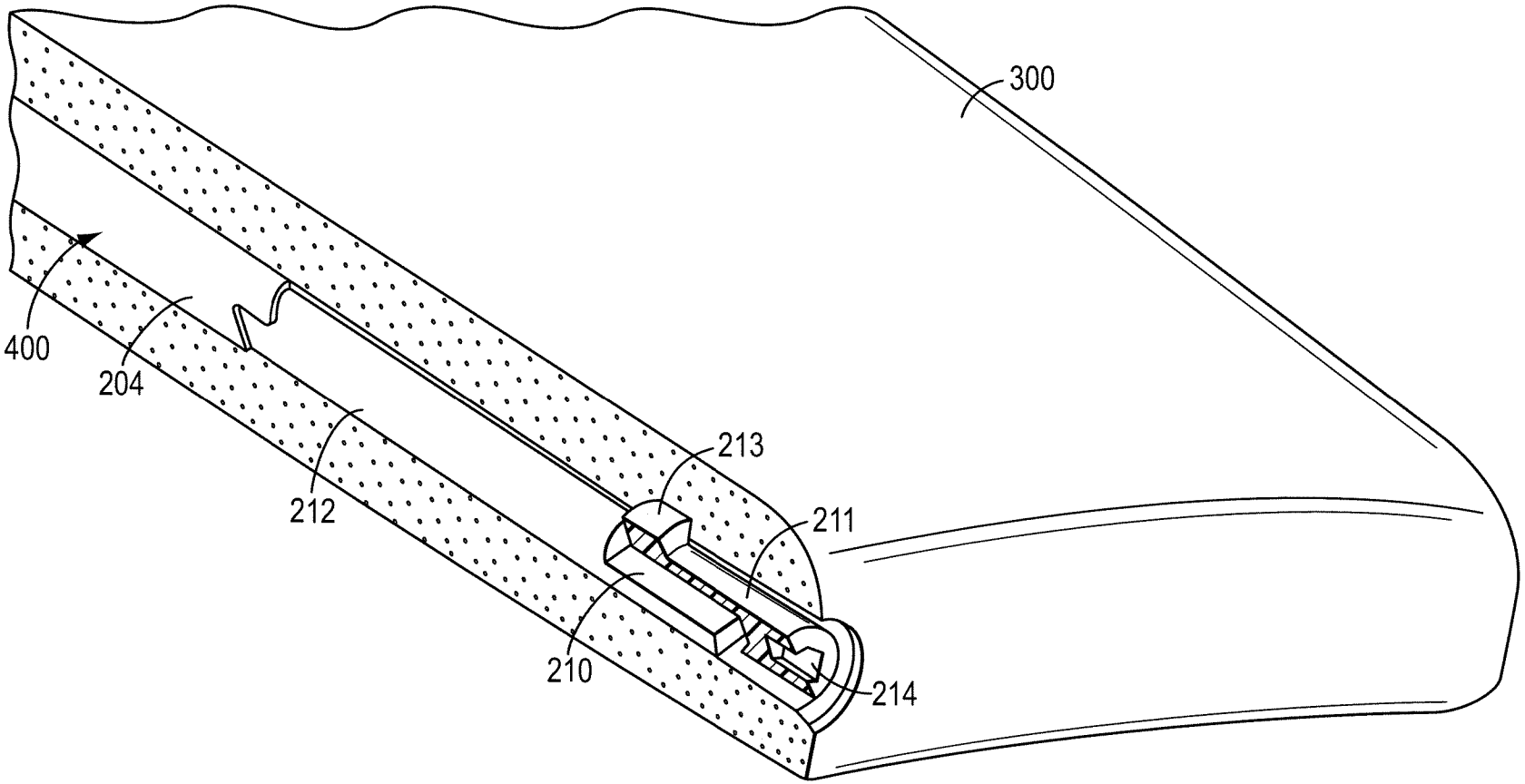
FIG. 6 illustrates a flex control mechanism according to one embodiment of the invention.

FIG. 6 is a partial cross-sectional view of waterboard 300 illustrating a stiffness control mechanism for stringer assembly 400 in one embodiment. As illustrated by the cutaway of housing 204 in FIG. 6, tenon 210 in shank 212 is engaged with a matching mortise in end cap 211. End cap 211 has a circular flange 213 which is captured by a matching channel feature in waterboard 300 and which allows end cap 211 and stringer element 205 to rotate under an applied torque. End cap 211 may also have a cylindrical body with a diameter smaller than circular flange 213, but large enough to have a fiction fit with a matching circular channel in waterboard 300 such that end cap 211 and stringer element 205 do not rotate in the absence of an applied torque. Finally, end cap 211 may also include a counter bore 214, which may be a polygonal counter bore 214, or may be a non-polygonal counter bore 214, as described above to accept a wrench or other torque applying tool to rotate stringer element 205 to adjust the stiffness of stringer assembly 400 within waterboard 300.

Figure 7A:
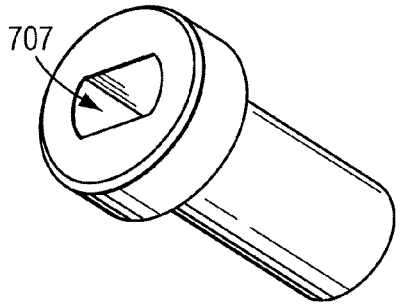
FIGS. 7A-7F illustrate a stringer retaining control mechanism according to one embodiment of the invention.
Figure 7B:
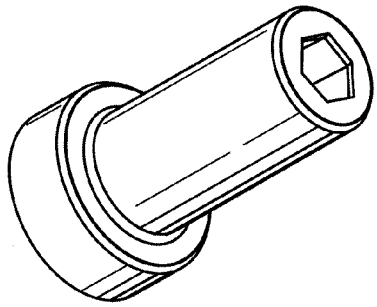
Figure 7C:
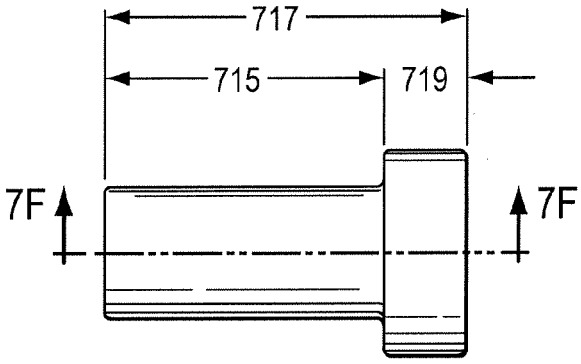

FIGS. 7A-7F illustrate the details of end cap 211 according to one embodiment of the invention. In the embodiment shown in FIGS. 7A-7F, end cap 211 is a circularly symmetrical end cap 211. It will be understood that an end cap 211 need not be circularly symmetrical, but that, in embodiments, an end cap 211 may have triangular, square, rectangular, or other polygonal features, or may have irregular features, and may or may not be symmetrical. As illustrated in FIG. 7C, an end cap 211 may have, for example, a length 717 of between about 0.5 inches to about 3.5 inches, or between about 1 inches to about 2.8 inches, or, in embodiments, may have a length 717 of about 2.2 inches. As illustrated in FIG. 7C, an end cap 211 may have a portion of smaller width and a portion of larger width; for example, a smaller width portion may have a length 715 of between about 0.5 inches to about 2.5 inches, or between about 1 inches to about 2 inches, or, in embodiments, may have a length 715 of about 1.7 inches. An end cap 211 may have a larger width portion with a length 719, for example, of between about 0.2 inches to about 1 inches, or of between about 0.3 inches and about 0.8 inches, or, in embodiments, may have a length 719 of about 0.5 inches.

Figure 7E:
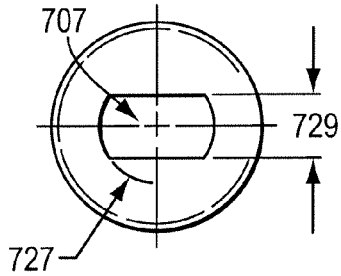
Figure 7D:
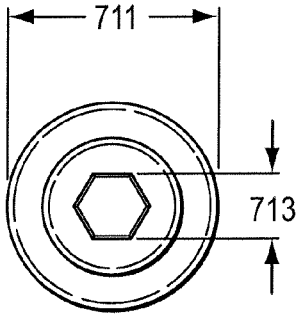

As illustrated in FIG. 7D, an end cap 211 may have, for example, a width 711 of between about 0.5 inches to about 1.5 inches, or between about 0.9 inches to about 1.3 inches, or, in embodiments, may have a width 711 of about 1.25 inches. A polygonal counter bore 214 may have a width 713, for example, of between about 0.1 and about 0.9 inches, or of between about 0.33 and about 0.5 inches, or, in embodiments, of about 0.38 inches.

As illustrated in FIG. 7E, an end cap 211 may have a mortise 707 configured to receive tenon 210 within a slot with a width 729; in embodiments, a width 729 may be between about 0.2 inches to about 0.6 inches, or may be between about 0.3 inches and about 0.5 inches, or, for example, a width 729 may be about 0.42 inches. A mortise 707 configured to receive a tenon 210 may have square or flat inner walls, or may, as illustrated in FIGS. 7A and 7E, for example, may have rounded walls. A rounded wall as illustrated in FIG. 7E may have a radius of curvature 727 of, for example, between about 0.2 inches and about 0.5 inches, or of between about 0.3 inches and about 0.4 inches, or, for example, may have a radius of curvature 727 of about 0.35 inches.

Figure 7F:
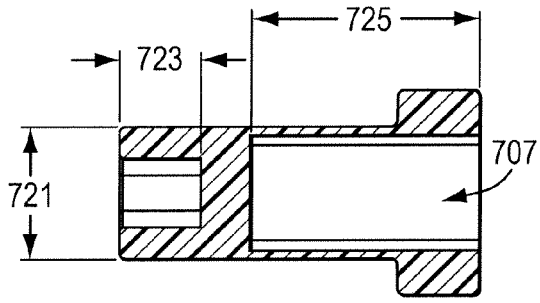

As illustrated in FIG. 7F, an end cap 211 may have a mortise 707 configured to receive a tenon portion 210, and, for example, within a cavity having a length 725 of between about 0.6 inches to about 1.8 inches, or of between about 0.8 inches and about 1.6 inches, or, for example, of about 1.4 inches. As illustrated in FIG. 7F, a counter bore 214 may have a depth 723, in embodiments, of between about 0.2 inches to about 0.8 inches, or of between about 0.3 inches and about 0.6 inches, or, for example, have a depth 723 of about 0.5 inches. In embodiments, as illustrated in FIG. 7F, an end cap 211 may have a width 721 of between about 0.5 inches to about 1.2 inches, or of between about 0.7 inches and about 1 inches, or, for example, of about 0.82 inches.

Figure 8:
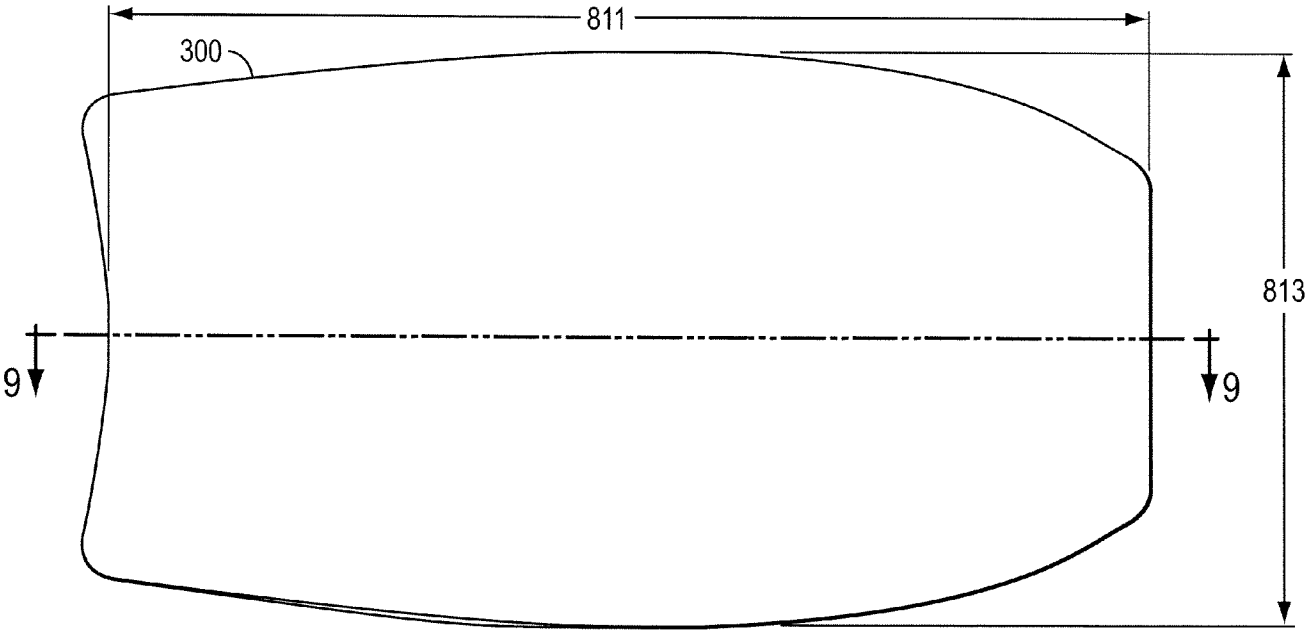
FIG. 8 illustrates a waterboard according to one embodiment of the invention.

FIG. 8 is a top view of waterboard 300 according to one embodiment of the invention. In embodiments, a waterboard 300 may have a length 811, for example, of between about 20 inches to about 60 inches, or of between about 30 inches and about 50 inches, or, for example, of about 40 inches. In embodiments, a waterboard 300 may have a width 813, for example, of between about 10 inches to about 30 inches, or of between about 15 inches and about 25 inches, or, for example, of about 22 inches.

Figure 9:
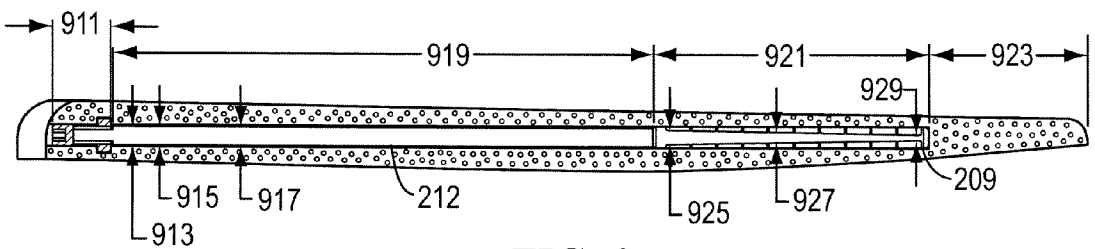
FIG. 9 is a cross-sectional view of FIG. 8 illustrating an adjustable flex stringer assembly according to one embodiment of the invention.

FIG. 9 is a cross-section of waterboard 300 through line 9-9 of FIG. 8. As illustrated in FIGS. 8 and 9, waterboard 300 may be approximately 40 inches long and approximately 20 inches wide. Stringer element 205 may be approximately 30 inches long, with approximately ⅔ of its length comprising shank 212 and ⅓ of its length comprising beam element 207. Stringer element 205 may be positioned within waterboard 300 such that disk 209 is located approximately 6 inches from the nose of waterboard 300.

As illustrated in FIG. 9, a waterboard 300 may have a first length 911 relating to an end cap 211, where first length 911 may be between about 1.5 inches and about 3 inches; in embodiments, a first length 911 may be about 2.2 inches. A waterboard 300 may have a second length 919 relating to shank 212; a second length 919, for example, may be between about 10 inches to about 30 inches, or between about 15 inches and about 25 inches, and may be, for example, about 21 inches. A waterboard 300 may have a third length 921 relating to beam element 207; a third length 921, for example, may be between about 5 inches to about 25 inches, or may be between about 8 inches and about 15 inches, and may be, for example, about 11 inches. A waterboard 300 may have a fourth length 923 as indicated in FIG. 9; a fourth length 923, for example, may be between about 3 inches to about 25 inches, or between about 4 inches and about 10 inches, and may be, for example, about 6.1 inches. A stringer element 205 may have widths 913, 915, 917, 925, 927, and 929; in embodiments, for example, widths 913, 915, 917, 925, 927, and 929 may be between about 0.1 inches and about 1.5 inches; or may be between about 0.15 inches and about 1 inch; or may be between about 0.2 inches and about 0.9 inches. In embodiments, for example, a width 913 may be about 0.8 inches; a width 915 may be about 0.7 inches; a width 917 may be about 0.68 inches; a width 925 may be about 0.55 inches; a width 927 may be about 0.41 inches; and a width 929 may be about 0.2 inches.

Embodiments of the invention described above include a single, longitudinally disposed adjustable flex stringer assembly. However, embodiments of the invention are not so limited. For example, two or more adjustable flex stringers may be disposed within the body of the waterboard and may be oriented at angles such that their respective endcaps and points of adjustment are located on the sides of the waterboard or at the leading edges of the waterboard. Other configurations not so limited are also contemplated to be within the scope of the invention.

Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A waterboard having externally adjustable stiffness, comprising:

a generally elongated foam core having a forward nose and a rearward tail and a longitudinally disposed channel, the channel having an approximately uniform cross-section, an opening at the tail and terminating within the foam core within a forward portion of the foam core;

an adjustable flex stringer assembly disposed substantially within the channel, comprising:

a housing having a cylindrical bore and an external cross-section configured to create a friction or interference fit with the channel, occupying a rearwards portion of the channel;

a stringer comprising a cylindrical shank disposed within the cylindrical bore of the housing, and a beam element disposed within approximately a forward third of the channel;

an end cap engaged with the cylindrical shank and configured to rotate the stringer under an application of torque, wherein a stiffness of the beam element in a direction normal to a surface of the waterboard is modulated between a minimum stiffness and a maximum stiffness.

2. The waterboard of claim 1, wherein said beam element has a broad dimension and a narrow dimension.

3. The waterboard of claim 1, wherein said beam element has a beam element length, and wherein said beam element comprises an asymmetric cross-section along at least a portion of said beam element length.

4. The waterboard of claim 3, wherein said beam element has an end and further comprises a disk element disposed at said end of said beam element, said disk element having a diameter, wherein said diameter is substantially the same as, or less than, that of said cross-section of said channel.

5. The waterboard of claim 3, wherein said beam element has an end and further comprises an intermediate disk element disposed away from said end of said beam element, said intermediate disk element having a diameter, wherein said diameter is substantially the same as, or less than, that of said cross-section of said channel.

6. The waterboard of claim 1, wherein said cylindrical shank further comprises a tenon portion.

7. The waterboard of claim 2, wherein said beam element is stiffer with respect to applied force substantially parallel to said broad dimension than with respect to applied force substantially perpendicular to said broad dimension.

8. The waterboard of claim 1, further comprising an anti-buckling element disposed adjacent said beam element within said channel.

9. The waterboard of claim 1, further comprising a counter bore configured to receive a torque applying tool.

10. A method of adjusting the stiffness of a waterboard, comprising the steps of:

rotating an adjustable flex stringer within a channel within a waterboard, wherein said adjustable flex stringer comprises a beam element disposed within the channel, said beam element having a broad dimension and a narrow dimension, said beam element having greater stiffness with respect to applied force substantially parallel to said broad dimension than with respect to applied force substantially perpendicular to said broad dimension, Wherein said rotating step is effective to position said beam element in an orientation within said channel effective to adjust the stiffness of the waterboard.

11. The method of claim 10, wherein said adjustable flex stringer further comprises a cylindrical shank.

12. The method of claim 10, wherein said adjustable flex stringer is disposed within a channel within said waterboard.

13. The method of claim 12, wherein said beam element is disposed within approximately a forward third of the channel.

14. The method of claim 12, wherein a spacer is disposed within said channel, and wherein said beam element is disposed adjacent said spacer within said channel.

15. The method of claim 12, wherein said beam element comprises a disk element effective to maintain said beam element in a desired position within said channel.

16. A waterboard having externally adjustable stiffness, comprising:

a generally elongated foam core having a forward nose and a rearward tail and a longitudinally disposed channel, the channel having an approximately uniform cross-section, an opening at the tail and terminating within the foam core within a forward portion of the foam core;

an adjustable flex stringer assembly disposed substantially within the channel, comprising:

a stringer comprising a shank portion and a beam portion, said shank portion being disposed rearward of said beam portion when said adjustable flex stringer assembly is in position within said channel, said beam portion including a beam element disposed within approximately a forward third of the channel; and an end cap engaged with the shank and configured to rotate the stringer under an application of torque, wherein the stiffness of the beam element in a direction normal to a surface of the waterboard is modulated between a minimum stiffness and a maximum stiffness.

17. The waterboard of claim 16, wherein said beam element has a broad dimension, a narrow dimension, and a beam element length, and wherein said beam element comprises an asymmetric cross-section along at least a portion of said beam element length.

18. The waterboard of claim 17, wherein said beam element is stiffer with respect to applied force substantially parallel to said broad dimension than with respect to applied force substantially perpendicular to said broad dimension.

19. The waterboard of claim 16, wherein said beam element has an end and further comprises a disk element disposed at said end of said beam element, said disk element having a diameter, wherein said diameter is substantially the same as, or less than, that of said cross-section of said channel.

20. The waterboard of claim 19, wherein said beam element further comprises an intermediate disk element disposed away from said end of said beam element, said intermediate disk element having a diameter, wherein said diameter is substantially the same as, or less than, that of said cross-section of said channel.

* * * * *